US006726424B2

(12) United States Patent
Voss

(10) Patent No.: US 6,726,424 B2
(45) Date of Patent: Apr. 27, 2004

(54) METHOD AND DEVICE FOR CONDUCTING BOOKS OUT OF A BOOK CASING-IN MACHINE

(75) Inventor: Reimer Voss, Belm (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/952,751

(22) Filed: Sep. 14, 2001

(65) Prior Publication Data

US 2002/0076304 A1 Jun. 20, 2002

(30) Foreign Application Priority Data

Sep. 14, 2000 (DE) ..... 100 45 400

(51) Int. Cl.[7] ..... B42C 9/00; B42C 7/00; B42C 11/04

(52) U.S. Cl. ..... 412/3; 412/1; 412/5; 412/9; 412/17; 412/19; 412/21; 270/58.07; 270/58.08

(58) Field of Search ..... 412/3, 5, 17–19, 412/21, 9; 270/58.07, 58.08

(56) References Cited

U.S. PATENT DOCUMENTS

| | | | | | |
|---|---|---|---|---|---|
| 2,640,208 | A | * | 6/1953 | Florez et al. | 412/8 |
| 2,921,322 | A | * | 1/1960 | Crawley et al. | 412/13 |
| 3,451,082 | A | * | 6/1969 | Sarring | 412/5 |
| 4,491,448 | A | * | 1/1985 | Anders et al. | 412/21 |
| 4,556,353 | A | * | 12/1985 | Ehlermann | 412/5 |
| 4,923,351 | A | * | 5/1990 | Nishikawa | 412/6 |
| 5,114,292 | A | * | 5/1992 | Geiser | 412/11 |
| 5,114,293 | A | * | 5/1992 | Rathert | 412/30 |
| 5,658,111 | A | * | 8/1997 | Rathert | 412/30 |
| 5,800,110 | A | * | 9/1998 | Georgitsis et al. | 412/3 |
| 5,868,539 | A | * | 2/1999 | Rathert | 412/5 |
| 6,142,721 | A | * | 11/2000 | Marsh | 412/1 |
| 6,206,358 | B1 | * | 3/2001 | Yamaguchi et al. | 270/52.02 |
| 6,250,868 | B1 | * | 6/2001 | Schmucker | 412/25 |
| 6,257,567 | B1 | * | 7/2001 | Hansmann et al. | 270/58.07 |
| 6,352,252 | B1 | * | 3/2002 | Schmucker et al. | 270/58.07 |
| 6,497,544 | B1 | * | 12/2002 | Schmucker et al. | 412/17 |
| 2001/0014265 | A1 | * | 8/2001 | Holtmeir et al. | 412/5 |
| 2002/0071742 | A1 | * | 6/2002 | Brommer et al. | 412/9 |

FOREIGN PATENT DOCUMENTS

| | | | |
|---|---|---|---|
| DE | 1536505 | * | 2/1970 |
| DE | 2810518 A1 | * | 10/1978 |
| DE | 19748832 A1 | * | 5/1999 |

* cited by examiner

*Primary Examiner*—A. L. Wellington
*Assistant Examiner*—Mark T. Henderson
(74) *Attorney, Agent, or Firm*—Alix, Yale & Ristas, LLP

(57) ABSTRACT

For a book casing-in machine, there is provided a method in which, while being conducted out, the books are shaped in the fold and pressed over their entire area and are held in a force-locking manner until they are deposited in the lying-flat condition. The device for performing the method has a conducting-out conveyer which takes over the book from the casing-in point and has shaping rails which engage in the fold and pressing rails which effect clasping in the region close to the fold. The device also has a book-delivery gripper which takes over the book from the conducting-out conveyer and feeds the book to pressing rollers which are driven in rotation and which roll along on the lateral faces of the book.

6 Claims, 2 Drawing Sheets

METHOD AND DEVICE FOR CONDUCTING BOOKS OUT OF A BOOK CASING-IN MACHINE

BACKGROUND OF THE INVENTION

The present invention relates to a method and device for conducting books out of a book casing-in machine.

From German Laid-Open Specification 1 536 505, for example, a book casing-in machine is known which has a circulating conveyer with chains which lie in mutually parallel vertical planes and are guided round deflecting wheels, and a large number of saddle plates at equal distances from one another, which are articulated on the chains and aligned horizontally. For the joining-together of the book block and the book cover, the so-called "casing-in operation", the book blocks are fed in, standing on a web with their front edge, by a conveyer and, in the process, are pushed onto a separating component, so as to then be taken over by the saddle plates, in a manner straddling the latter, through the fact that the saddle plates travel through the separating component.

For the casing of the book blocks into the book covers in a register-true manner, pressing-on elements are provided which can be moved upwards, synchronously with the conveyer, and operate alternately and which are laid on the back of the book or on the back of the book covers and are capable of traveling in closed, loop-shaped paths of movement, upwards from a starting position adjacent to the book, and also downwards on a path which is separate from the path of movement of the book, and back into the starting position again.

The books which are carried by the saddle plates, in a manner straddling the latter, and which move downwards on the perpendicular path of movement are delivered in a book-discharging device, through the fact that the books are supported on a stripping component with a transit slot for the saddle plates and are deposited on a conveyer via a relocating plate which moves to and fro. When the books are discharged, there is a danger of their becoming detached, since the downwardly moving books are supported onto the stationary stripping components in an unbraked manner and are deposited by being tipped onto a continuously running conveyer belt.

In a book shaping-and-pressing machine which follows the book casing-in machine and is represented and described, by way of an example, in U.S. Pat. No. 2,921,322, the books are placed and aligned on their backs. Shapers press the block of the book into the back of the book cover which is supported in a shaping web. The aligning station is followed by pressing devices which are disposed in a straight row and at equal distances from another and which each have a pair of pressing plates, which are opposed at a variable distance, for exerting a pressing effect on the two sides of a book. Associated with the pressing devices are heated fold burning-in rails, which in each case are opposed in pairs at a variable distance, for shaping the fold of the book cover. The fold-shaping rails are located on a carriage and simultaneously serve as transport means in order to move the books on stepwise from station to station, only to then return to their starting position for the purpose of picking up and transporting a subsequent book.

The intention is, by means of the so-called "fold burning-in operation", to form a recessed, triangular line on the covering material of the book cover along the inner edge of the paperboard of the book board under the effect of heat on the covering material of the book cover. In order to achieve a permanent shape for the fold, sticking is effected via a coating of hot melt or a reinforced coating of dispersion glue in the region of the fold of the book block.

The books which have not yet been completely pressed and shaped in the fold are exposed, during infeed and alignment, to loadings which can lead to the displacement or detachment of the board sides from the book block. In the course of the subsequent burning-in of the fold and pressing of the books as a whole, creases are then impressed on the insides of the boards. The devices in this machine are relatively expensive.

In German Laid-Open Specification 197 48 832, a book shaping-and-pressing machine is represented and described, which is represented as a compact, simple structural unit which can be manufactured cost-effectively. In a first station, very high pressing forces are transmitted, as a result of linear contact, by means of pressing rollers which are driven in rotation and roll along on the lateral faces of the books and, in the process, possible inclusions of air are progressively eliminated by rolling-out. In a second station, the books are aligned in a crease-free manner as a result of the preceding pressing operation and the consequent firm sticking, and are shaped in the fold by means of fold-shaping rails and pressing rails for the region close to the fold.

Suitable conveying elements are provided for moving the books forward through the book shaping-and-pressing machine in a cyclical manner.

From German Laid-Open Specification 1 99 55 993, for example, a book casing-in machine is known which has a run-in conveyer which feeds the book blocks, with their backs pointing upwards, to a lower picking-up point and has an arrangement which spreads out the outer end papers of the book blocks and a gripper which grasps the book blocks between the spread-out outer end papers and conveys them out of the lower picking-up point and into an upper joining point.

At the joining point, the book block, which is coated with glue on the outer end papers on the path upwards, is stuck to the inner faces of the sides of the board of the book cover, which is fed by folding flaps according to a cycle and is held in position, through the fact that shaping rails belonging to a conducting-out conveyer first of all engage in the fold of the book, the gripper releases the book block and travels downwards from the book and the folding flaps bring the spread-out book boards up to the book block in a closing movement. The book which is held by means of the shaping rails of the conducting-out conveyer is moved out of the joining point, after the release of the book cover by the folding flaps, and delivered up to a known book-delivery system.

SUMMARY OF THE INVENTION

The object of the invention consists in providing a method and device for conducting books out of a book casing-in machine, which permit an improvement in quality in the manufacture of books using the casing-in, shaping and pressing process steps, and which are distinguished by a relatively simple and cost-effective mode of construction.

By means of the method and device according to the invention, the folds of the books are gripped, during the casing-in operation, by shaping rails belonging to a conducting-out conveyer, and are shaped by the use of force and, optionally, heat. After the casing-in operation, pressing rails belonging to the conducting-out conveyer which are additionally brought up to the regions of the fold of the book, permit secure transport and are already pressing that region of the book cover which is close to the fold, against the book block. As a result of the taking-over of the book, which is still held by the conducting-out conveyer, by a book-delivery gripper which catches onto the sides of the boards in a force-locking manner, the book is safely deposited from its vertical position, with the back of the book pointing upwards, onto the lower roller of a pair of pressing rollers in the lying-flat condition. The upper roller alights when at a standstill and, jointly with the lower roller, conveys the book out of the book casing-in machine by rolling along on the sides of the book. In the process, the pressing operation begins in a region which has already been pressed on by the pressing rails of the conducting-out conveyer, so that the sides of the book boards are stuck firmly throughout, over their full area and without air inclusions, to the outer end papers of the book block.

BRIEF DESCRIPTION OF THE DRAWINGS

The invention will be explained in greater detail below with the aid of an exemplified embodiment represented in the drawings, in which.

DETAILED DESCRIPTION OF THE PREFERRED EMBODIMENT

Figure 1:
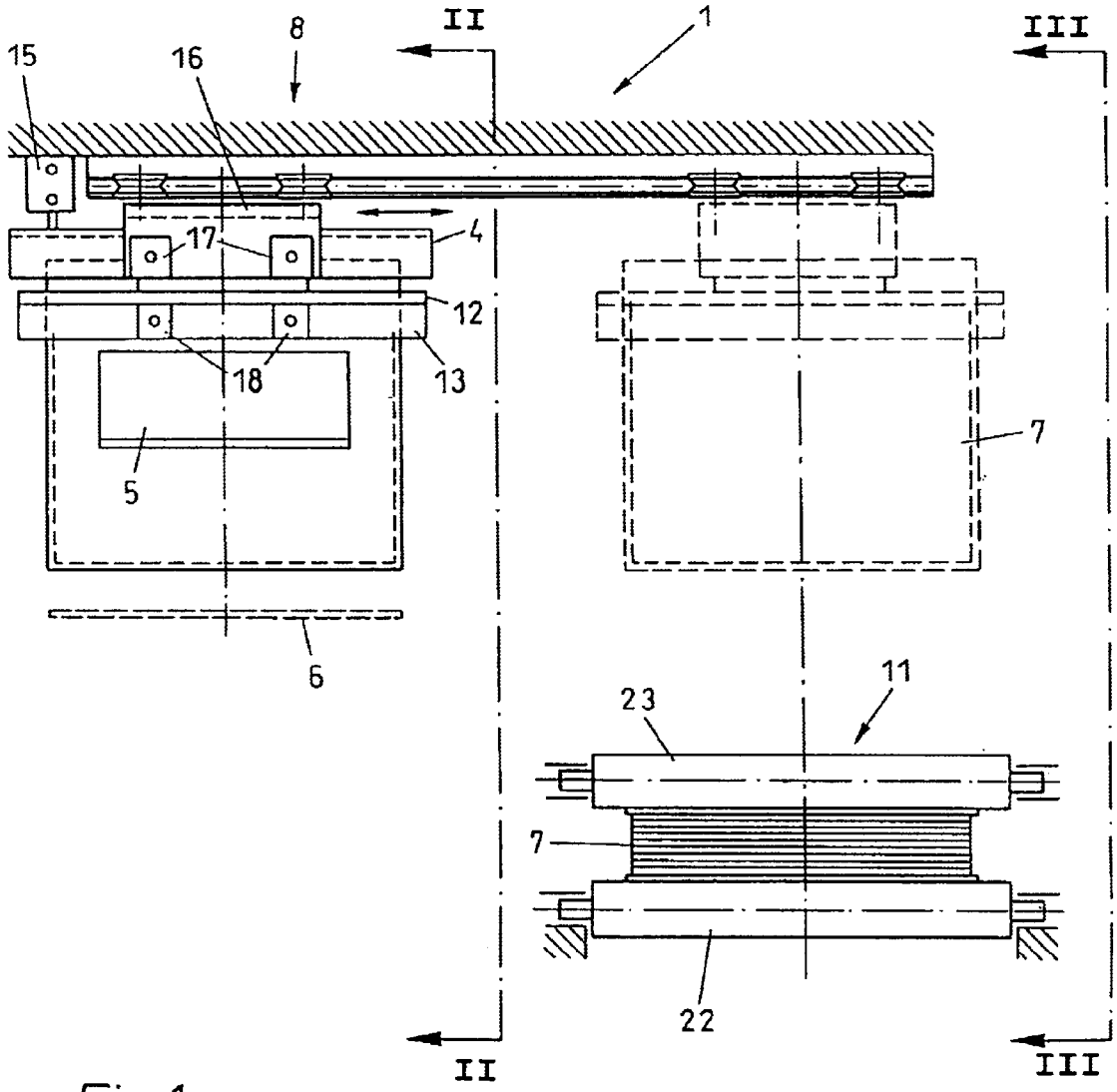
FIG. 1 is a side elevation view of a book conducting-out system for a book casing-in machine in accordance with the invention.
Figure 2:
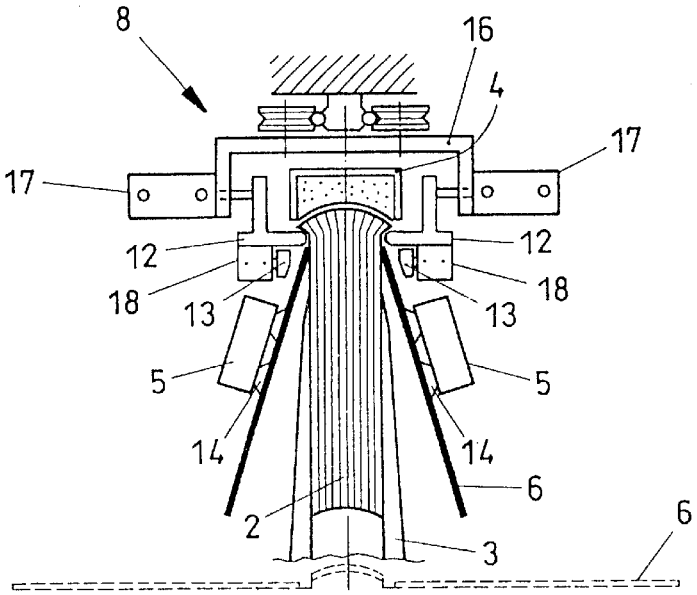
FIG. 2 is a cross-section view taken along line II—II of FIG. 1.
Figure 3:
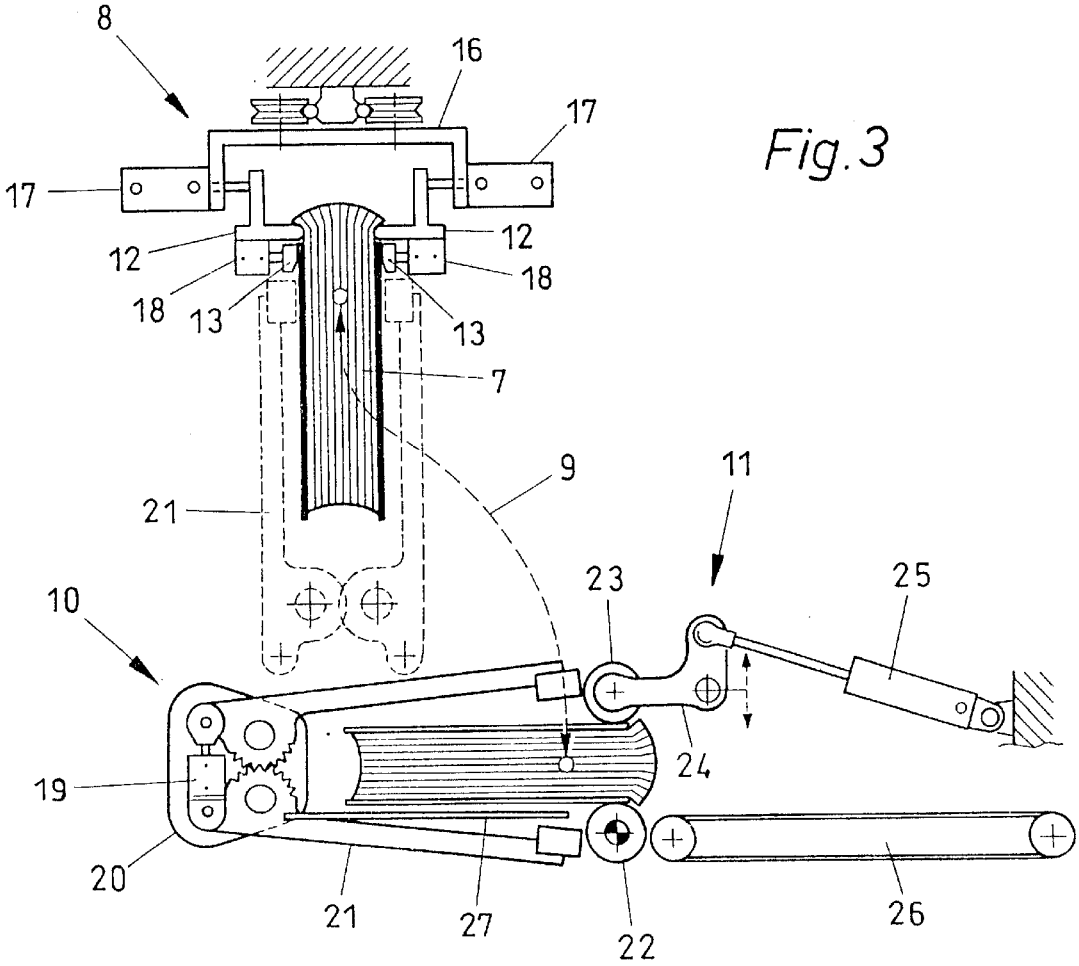
FIG. 3 is a cross-section view taken along line III—III of FIG. 1.

In a book casing-in machine, a book block 2 is transported by a gripper 3 which grasps the book block 2 between the spread-out outer end papers and conveys it out of a lower picking-up point and into an upper joining point, in the process of which the book block is coated with glue on the outer sides of the spread-out end papers and pressed into a book cover 6 which supports the back against an elastic shaping piece 4 and holds the boards in a spread-out position by folding flaps 5.

The book conducting-out system 1 substantially consists of a conducting-out conveyer 8 which transports the books 7 in the horizontal plane in the direction of the height of the books, a book-delivery gripper 10 which puts the books down in a combined lowering-and-pivoting movement, and a pressing-roller system 11 which conveys the books 7, which are now lying flat, out with the aid of pressing rollers 22, 23 which are driven in rotation, roll along on the lateral faces of the book 7 and effect conveyance in the direction of the width of the book.

The so-called "casing-in" of the book 7 is effected by the pressing of the book block 2 into a book cover 6 which is held by the folding flaps 5 with the boards spread out and is supported against the elastic shaping piece 4, by the seizing of the fold of the book by shaping rails 12 belonging to the conducting-out conveyer 8 and, after the release of the book block 2 by the gripper 3, by the laying-on of the boards against the book block 2 with the aid of the folding flaps 5, and the clasping of the book 7 via the lateral faces close to the fold with the aid of pressing rails 13 belonging to the conducting-out conveyer 8.

The folding flaps 5, which have suction components 14, take over the boards of the book cover 6, which is lying flat, is conveyed by a book-cover conveyer, not represented here, in the plane of the boards and is held in position, in order to transfer the book cover, by the back, into the upper joining position in a lifting-and-pivoting movement.

The elastic shaping piece 4, which is interchangeable for adaptation to the shape and width of the back of the book, is moved up and down by a pneumatic cylinder 15 in order to release the cased-in book 7 for the purpose of conducting it out with the aid of the conducting-out conveyer 8.

The conducting-out conveyer 8 consists of a travelling carriage 16 which is moved to and fro, with a constant stroke orientated to the center of the book's height, by driving means which are not represented here, and of shaping rails 12 which can be moved transversely to the direction of transport and are guided on the traveling carriage, and also of further pressing rails 13. The shaping rails 12, whose clamping force can be set, are actuated in a forcibly coupled manner by pneumatic cylinders 17 and by means which are not shown here, and set themselves automatically to the thickness of the book. The shaping rails 12 may be heated in order to burn-in a fold during the casing-in and transport operations. Unheated shaping rails 12 stabilize and stick a fold which has already been incorporated in the book cover 6 before the casing-in operation, and shape the fold afterwards under the effect of force and the residual heat of a hot coating of glue which has been applied, in the region of the fold, to the block 2 or to the book cover 6 before the casing-in operation.

The pressing rails 13 of the conducting-out conveyer 8 can be moved, relative to the shaping rails 12, by pneumatic cylinders 18 fastened to the shaping rails 12, and clasp the book 7, after the laying-on of the boards of the book against the book block 2, in that region of the lateral faces of the book 7 which is close to the fold. The clamping surface, with the aid of which the book 7 is held for transport purposes, is enlarged and that region of the lateral faces of the book 7 which is close to the fold is pressed on at the same time, and a scrim, which may optionally be applied to the back of the block, is brought into intensive sticking connection with the book cover 6 and the sides of the block. The clamping force of the pressing rails 13 can be set, relative to the shaping rails 12, and can also be permanently activated so that books without a pronounced fold can be safely cased-in and transported.

After the release of the boards of the book cover 6 by the folding flaps 5, the conducting-out conveyer 8 transports the book 7 out of the joining point and delivers the book 7 up to the book-delivery gripper 10. Gripping tongs 21 belonging to the book-delivery gripper 10, which gripping tongs can be automatically set to the thickness of the book, are actuated by a pneumatic cylinder 19 and are mounted on a plate 20, grasp the book 7 underneath the pressing rails 13 of the conducting-out conveyer 8, without the book 7 being left on its own in the process. In a combined pivoting-and-rotating movement of the plate 20, which movement is generated by a four-bar linkage not shown here, the book 7 is first of all moved perpendicularly downwards out of the open conducting-out conveyer 8, in order to then be deposited in the lying-flat condition, with the coupling curve 9 which is represented in broken lines for a point on the book, on a lower pressing roller 22 and an adjoining supporting surface 27 belonging to the pressing-roller system 11.

An upper pressing roller 23 can be format-adjusted to the thickness of the book, and is pivotably mounted, for opening and closing purposes, in a frame 24, for the depositing of the book 7 by the book-delivery gripper 10. Pivoting takes place via a pneumatic cylinder 25 which also applies the pressing force which can be set. The diameter of the two pressing rollers 22, 23 and the position in which the book 7 is deposited between the pressing rollers 22, 23 are coordinated with one another in such a way that any projecting fold is not damaged, but on the other hand is pressed on, even in a region which has already been grasped by the pressing rails 13 of the conducting-out conveyer 8.

After the release of the book 7 by the book-delivery gripper 10, the pressing rollers 22, 23, which are driven in rotation and which roll along on the lateral faces of the book 7, convey the book 7 to an onward conveyer 26. In the process, very high pressing forces are transmitted to the book 7 as a result of the linear contact, and possible inclusions of air are progressively eliminated by rolling-out.

What is claimed is:

1. A device for conducting books out of a book casing-in machine, each book including a fold, a book cover, and a book block disposed within the book cover, the book cover having a pair of lateral faces, each of the lateral faces having an area, the device comprising:

a conveyor including first and second shaping rails adapted for grasping each book in the fold and first and second pressing rails adapted for clamping each book in a region proximate to the fold;

a pressing-roller system adapted for pressing the lateral faces of each book over their entire area; and a book-delivery gripper adapted for feeding each book from the conveyor to the pressing-roller system.

2. Device according to claim 1 wherein the conveyor also includes at least one pneumatic cylinder coupled to each shaping rail for moving the shaping rails relative to each other and for applying a predetermined force to the book in the fold.

3. Device according to claim 1 wherein the book-delivery gripper is adapted for gripping each book while the book is clamped in the conveyor, conveying the book while holding the book in a force-locking manner, and depositing the book in a lying-flat condition.

4. Device according to claim 1 wherein the shaping rails act on the book with heat and force.

5. A device for conducting books out of a book casing-in machine, each book including a fold, a book cover, and a book block disposed within the book cover, the book cover having a pair of lateral faces, each of the lateral faces having an area, the device comprising:

a conveyor including first and second shaping rails adapted for grasping each book in the fold and first and second pressing rails adapted for clamping each book in a region proximate to the fold;

a pressing-roller system adapted for pressing the lateral faces of each book over their entire area; and a book-delivery gripper adapted for feeding each book from the conveyor to the pressing-roller system;

wherein the first and second pressing rails are connected to the first and second shaping rails, respectively, by at least one pneumatic cylinder for moving the pressing rails relative to the shaping rails and for applying a force to the book in the region proximate to the fold.

6. A device for conducting books out of a book casing-in machine, each book including a fold, a book cover, and a book block disposed within the book cover, the book cover having a pair of lateral faces, each of the lateral faces having an area, the device comprising:

a conveyor including first and second shaping rails adapted for grasping each book in the fold and first and second pressing rails adapted for clamping each book in a region proximate to the fold;

a pressing-roller system adapted for pressing the lateral faces of each book over their entire area the pressing-roller system including vertically separated, rotatably driveable, upper and lower pressing rollers and a supporting surface adjoining the lower pressing roller, the upper pressing roller being moveable between open and closed positions; and a book-delivery gripper adapted for feeding each book from the conveyor to the pressing-roller system;

wherein the book-delivery gripper deposits a book on the lower pressing roller and supporting surface when the upper pressing roller is in the open position, the lower pressing roller engaging a lower of the lateral faces of the book in the region proximate to the fold, the upper pressing roller engaging an upper of the lateral faces of the book when the upper pressing roller is in the closed position, whereby the upper and lower pressing rollers press on the lateral faces of the book with a predetermined force over their entire area, beginning in the region proximate to the fold and transfer the book out of the device.

* * * * *